United States Patent [19]

Lewis et al.

[11] 4,077,581

[45] Mar. 7, 1978

[54] PAPER DRIVE MECHANISM

[75] Inventors: Kim R. Lewis, Lansing; William H. Corbett, Ithaca, both of N.Y.

[73] Assignee: NCR Corporation, Dayton, Ohio

[21] Appl. No.: 638,797

[22] Filed: Dec. 8, 1975

[51] Int. Cl.[2] ..... B65H 17/08

[52] U.S. Cl. ..... 242/67.3 R; 242/75.1

[58] Field of Search ..... 242/67.3 R, 67.5, 67.2, 242/67.1, 65, 75.1, 192, 201, 67.4, 55

[56] References Cited

U.S. PATENT DOCUMENTS

| | | | |
|---|---|---|---|
| 1,017,984 | 2/1912 | Martin | 242/67.3 R |
| 1,563,382 | 12/1925 | Legg | 242/67.3 R |
| 2,732,437 | 1/1956 | Travis, Jr. | 242/192 X |
| 3,520,495 | 7/1970 | Sotani | 242/199 X |
| 3,758,049 | 9/1973 | Staar | 242/201 |
| 3,834,638 | 9/1974 | Savage et al. | 242/75.1 |
| 3,895,766 | 7/1975 | Thevenaz | 242/201 |

*Primary Examiner*—George F. Mautz
*Attorney, Agent, or Firm*—J. T. Cavender; Wilbert Hawk, Jr.; George J. Muckenthaler

[57] ABSTRACT

Paper or like media, utilized for maintaining a permanent record of printed matter, is driven by a drive roller and is caused to be wound on a spool or core which is swingable from the drive roller as the amount of paper on the spool increases. An "O" ring drive is positioned between a main drive line for intermittent engagement therewith and is connected with the spool for driving thereof.

6 Claims, 3 Drawing Figures

PAPER DRIVE MECHANISM

BACKGROUND OF THE INVENTION

Figure 1:
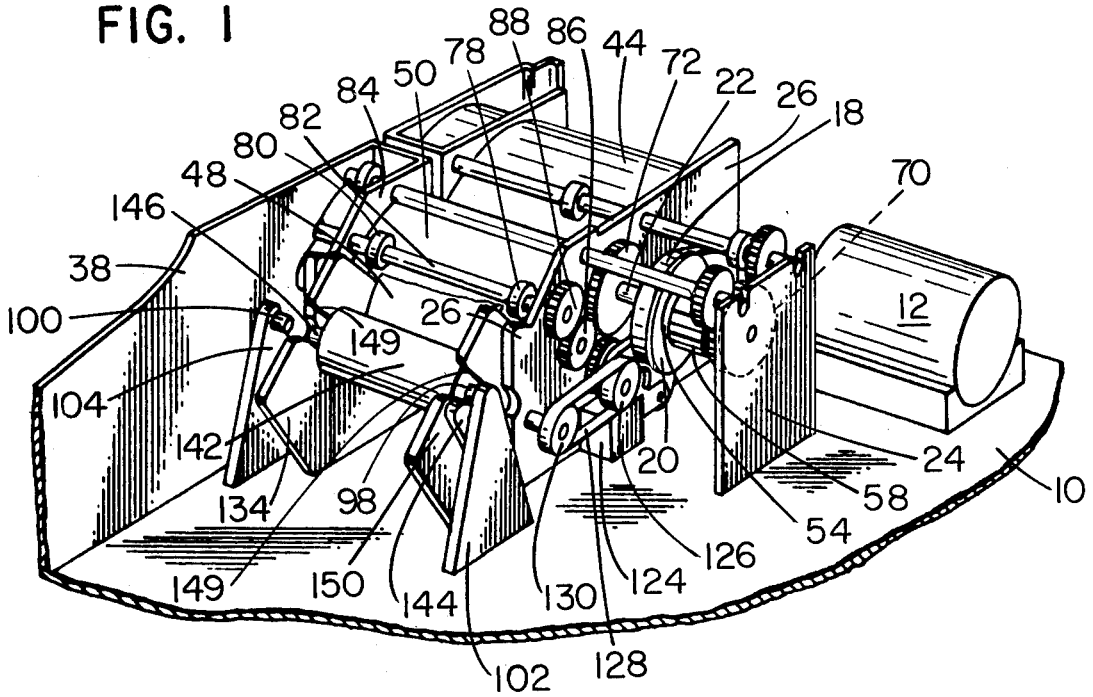

In the area of printing devices and paper feed mechanisms in business machines, the matrix type printer has evolved for reasons of compact design and fast operation long with the continued need for more than one type of transaction to be performed by the machine. In a number of business machines, a receipt is printed and is provided for the customer, an audit or journal is printed for retaining a permanent record on a spool or core within the machine, and printing may also be provided on a slip or document which may be either returned to the customer or retained by the machine operator. The business machines may be designed with a plurality of printing stations, each with its associated printing device, or one printing device may accommodate two or more printing stations by travel thereof across the several stations.

In the operation of the machine, the paper is incrementally driven or fed into position for the desired printing and then advanced to the next or succeeding line. In the case of the receipt station, the paper roll is inserted into the machine and as each receipt transaction is completed, a portion of the paper in the form of a receipt is handed to the customer. In the case of the journal or audit station, the paper roll is likewise inserted into the macine and as the paper is moved or advanced across the journal printing station, it is caused to be rewound on a spool or core to retain a record of the transactions in the machine. It is the journal drive and roll assembly to which the present invention is directed. Representative of an assembly for spooling an audit trail in a data terminal is the showing in Savage et al. U.S. Pat. 3,834,638, wherein an audit trail is spooled by the paper traveling from a supply roll across a cover and around a roller to be wound on a spool positioned in a slot, there being a movable drive belt directly engageable with the paper to rotate the paper and the spool, and which is spring loaded in one direction and swingable away from the spool as the paper on the spool increases in diameter.

SUMMARY OF THE INVENTION

The present invention relates to high speed printing and more particularly to the drive or feed mechanism for advancing or moving paper or like media from a supply roll across a printing station and onto a take-up spool wherein a belt or O-ring drive assembly is positioned to engageable with a main drive line and is connected with a drive roller which is directly engageable with the take-up paper for driving thereof. As the paper is wound on the take-up spool or core, the diameter of the paper roll thereon increases and the spool is mounted to be swingable in a direction away from the drive roller. One pulley about which the belt or O-ring is trained is carried on a pivoting arm which is movable into and out of engagement with the main drive, the home position of the pivoting arm being in the disengaged position, regularly maintained thereat by reason of the tension in the O-ring and, upon a command for advancing the paper, a solenoid is actuated to pivot a gear on the arm into engagement with the drive line and thereby drive the belt or ring and likewise the spool or core to advance the paper in an incremental manner for the printing operation.

In view of the above discussion, the principal object of the present invention is to provide an improved drive mechanism for record material in a business machine.

Another object of the present invention is to provide in a compact printer a paper drive mechanism occupying limited space for moving the paper past a printing station.

A further object of the present invention is to provide a paper drive mechanism wherein a belt or O-ring drives a roller which engages a paper roll or spool for driving thereof and said roll or spool movably swings from the drive roller as the diameter of said paper on the spool increases.

Figure 3:
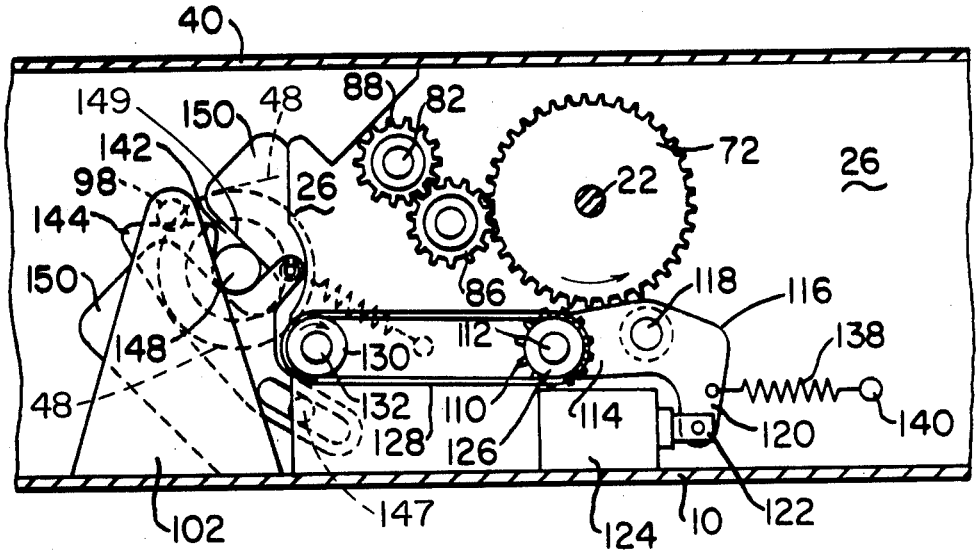
Figure 2:
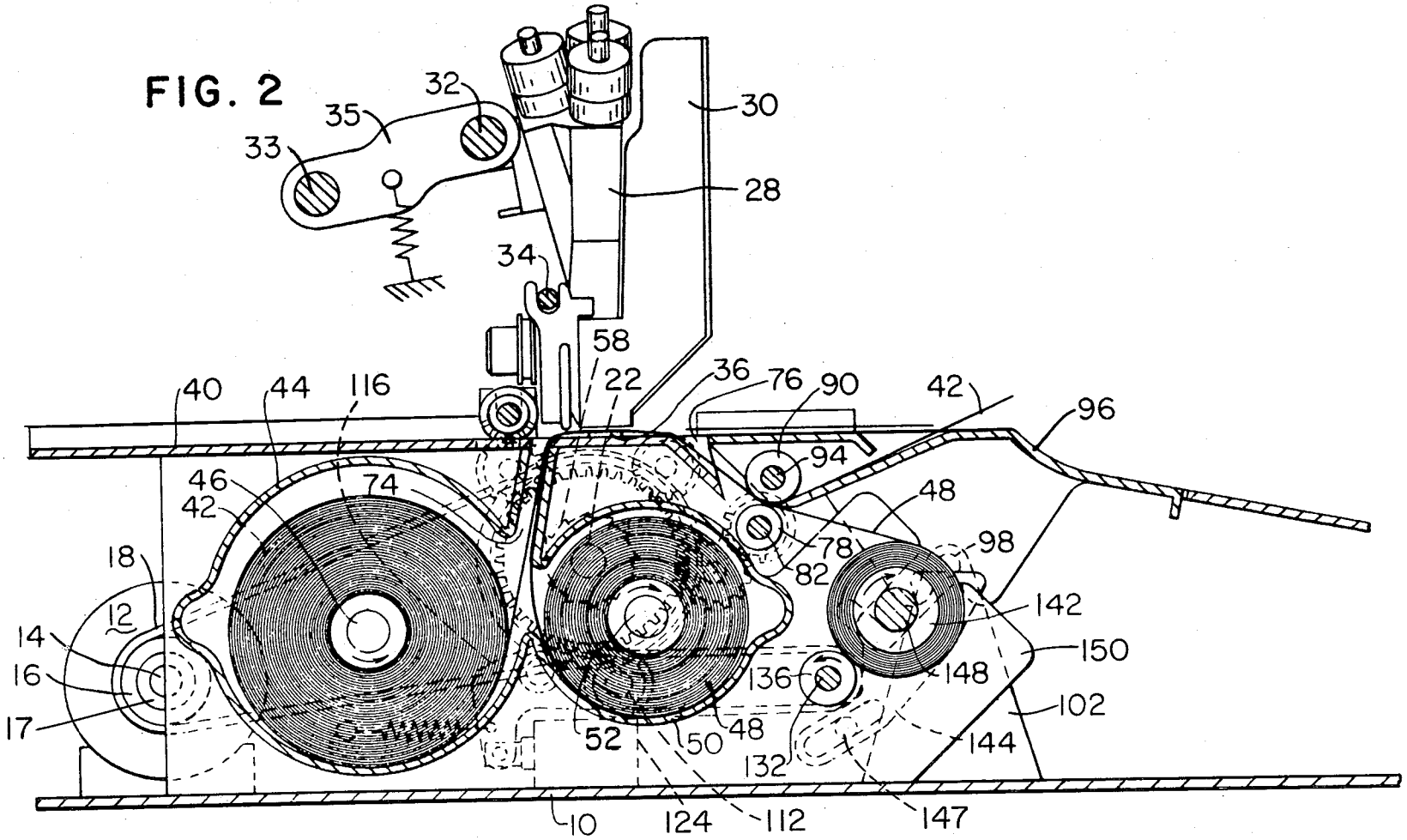

Additional advantages and features of the present invention will become apparent and fully understood from a reading of the following description taken together with the annexed drawings, in which:

FIG. 1 is a right front perspective view of a portion of a printer incorporating the subject matter of the present invention; mixture FIG. 2 is a left side elevational view showing the paper supply roll, the path of the printing media, and the drive and take-up rollers therefor; and FIG. 3 is a right side elevational view of the paper drive mechanism.

Referring now to the drawings, there is shown in FIG. 1 a perspective view of a print station portion of a printer incorporating the subject matter of the present invention, a disclosure of the overall machine being shown and described in a co-pending application, Ser. No. 638,796 filed Dec. 8, 1975, now abandoned, by the same inventors and entitled "Single Station, Plural Function Printer". In such FIG. 1, a base 10 supports printing mechanism which receives motion from a motor 12 having a shaft 14 (see FIG. 2) on which is mounted a drive pulley 16 containing a one-way bearing 17. The motor 12 may be of the bi-directional or reversing type, stepper motor or equivalent for driving the printing mechanism. A drive belt 18 is trained around the pulley 16 and around a pulley 20 secured to a main drive shaft 22 (FIG. 3), which shaft has one end thereof journaled in an upright support plate 24 secured to the base 10 and the other end journaled in a frame plate 26, likewise secured to the base 10 and extending along the right hand side of the printing area.

While FIG. 1 shows a print stationportion of a printer, certain elements thereof are not shown so as to clarify the area of invention. A print head 28 and a ribbon cassette 30, (FIG. 2) attached to the front of the print head, are caused to be driven in a side-to-side direction across the printing station by means of a shaft element 32, appropriately journaled in upstanding frame members or supports (not shown). Driving of the print head 28 ad the ribbon cassette 30 may be accomplished by means of the shaft element 32 itself with same being of the well-known lead screw type, or by means of a cord or cable which may be connected to the print head, and through an arrangement of pulleys, the head and cassette assembly is caused to be moved back and fourth across the print station. A spring-loaded bail 33 (FIG. 2) is connected to the shaft element 32 by means of a connecting arm 35 to permit slight up-and-down movement of the print head 28 in cushioning manner as it is caused to be moved across the machine and the printing station. The print head 28 may be of the matrix type which includes the solenoid drivers operated to cause printing on record media by wire elements or the like as such media is driven past the printing station.

However, since the print head 28 and the cassette 30 assembly forms no part of the present invention, further description of same is not necessary other than to state that a lower guide rod 34 is provided to maintain the print head along a precise path and attitude in relation to a platen 36 (FIG. 2) which comprises a flat, horizontally disposed member positioned across the machine at the printing station.

In addition to the base 10, the enclosure for certain lower parts of the machine include the right-hand side plate 26, a left-hand side plate 38 and a top plate or cover 40, FIGS. 2 and 3, which cover includes openings therein for passage of the record media in its path past the printing station, in addition to provisions for enabling certain related operations.

As mentioned previously, the full printer structure may include mechanism and apparatus for printing a receipt of the transaction, a journal or audit of the transaction, and also for printing on a slip or form inserted at the single printing station. As seen in FIG. 2 a supply of receipt paper 42 is contained or stored in an enclosure or well 44 and supported on a roller 46 which is caused to be rotated in a counter-clockwise direction for unwinding or unreeling of the paper to permit travel thereof in a path past the printing station and toward the front of the machine or toward the right in FIG. 2. A supply of journal paper 48 is likewise contained or stored in an enclosure or well 50 and supported on a roller 52 which is caused to be rotated in a clockwise direction for unwinding or unreeling of the paper 48 to permit travel thereof in a path past the printing station and toward the front of the machine, where the paper is rewound on a journal take-up roll to be maintained in the machine for audit purposes. The third function, that of printing on a slip or form, is effected when such slip or form is inserted into position on the upper plane of the top plate 40 and then caused to be moved rearwardly or to the left in FIG. 2 for a printing operation on the slip or form by the print head 28. Separate drive means for each of the several record media are included in the printer whereby a selection of the printing function is made possible.

Referring back to FIG. 1, the main drive shaft 22 extends from the support plate 24 to the side frame plate 26 and is journaled in said plates, the shaft 22 having assembled and secured thereon at the right side of pulley 20 and adjacent thereto, a single, twelve position incremental type spring clutch unit and actuator therefor — such clutch unit including a shaft input portion 54 — output hub portion arrangement under the control of a spring (not shown) and a ratchet 58 (see also FIG. 2) positioned to be engaged by a pawl actuated from a solenoid supported on a bracket secured to the side plate 24, the pawl, solenoid, and bracket not being shown, but of well-known design. While it should be mentioned that while the motor 12 may be of the reversing or bi-directional type to provide for back-and-forth or side-to-side travel of the print head 28 and cassette 30 assembly, the operation of the pawl solenoid is directed to the requirement for selecting one or more drive elements for driving the receipt paper 42, the journal paper 48, or for moving a slip or form inserted at the printing station.

Adjacent the right side of the spring clutch unit, FIG. 1, is a first main drive gear 70 secured to the shaft 22 to be driven thereby in a direction of rotation corresponding to the direction of rotation of the shaft 22. A second main drive gear 72 (see also FIG. 3) is secured to the shaft 22 at the left side thereof adjacent the side frame plate 26 for providing drive for the receipt paper 42 which travels in a path from the supply roll through a passageway 74, FIG. 2, past the printing platen 36, through a second passageway 76, and past receipt paper drive rolls 78 and 80 (FIG. 1) secured to a shaft 82 journaled in the right side frame plate 26 an in a left side frame plate 84. The second main drive gear 72 is engaged with and drives a spur gear 86 positioned on the right side of the frame plate 26 and secured to a stub shaft journaled therein, such spur gear 86 being engaged with the driving a gear 88 also positioned on the right side of frame plate 26 and secured to the shaft 82 for driving thereof along with the rollers 78 and 80. As seen in FIG. 2, the receipt paper 42 is caused to be positioned above the journal paper 48 when and after passing the printing platen or station, and although not illustrated, the receipt paper 42 is wider than the journal paper 48 which, as illustrated in FIG. 1, occupies the space between the receipt paper drive rolls 78 and 80. Cooperating with such drive rolls 78 and 80 is a pair of spaced pressure rollers 90 (only one shown in FIG. 2) secured to a shaft 94 journaled in side walls of a movable cover portion 96, which portion 96 is swingable on and removable from a pair of studs 98 and 100 secured to upright supports 102 and 104, FIG. 1, in turn secured to the base 10 of the machine.

Looking now to the drive means for the journal paper 48 which originates or is initiated from the main drive gear 72, FIGS. 1 and 2, a spur gear 110 is positioned below the gear 72 adjacent the side frame plate 26 and secured to a shaft 112. Such shaft 112 extends toward the right from the plate 26 for reception, as shown in FIG. 3, of one end 114 of a crank arm 116, which end 114 is journaled on the shaft 112, and with the arm 116 itself being pivoted on a pin 118 journaled in the side plate 26. The other end 120 of the arm 116 is connected with the plunger 112 of a solenoid 124 secured to the base 10 of the machine adjacent the side plate 26. A drive pulley 126 is secured on the right end of the shaft 112 and a belt or O-ring 128 is trained around the pulley 126 and extends forwardly to and around a pulley 130 secured to the right end of a shaft 132 extending leftwardly (FIG. 1) through the side plate 26 and across the journal paper width to an upright support plate 134, the shaft 132 being journaled in the plate 26 and in the plate 134. Shaft 132 has a friction drive roller 136 (FIG. 2) thereon for engaging with and directly driving the journal paper 48 upon demand when the solennoid 124 is actuated against the pull of a spring 138 connected to the crank arm 116 and to a stud 140 secured to the side plate 26. It should be here noted that the normal tension in the belt 128 normally maintains the arm 116 in a disengaged position — with the gear 110 disengaged from the drive gear 72 as illustrated in FIG. 3.

A journal take-up core or roll 142 (FIGS. 2 and 3) is carried by a pair of support arms 144 and 146 by means of a shaft 148 seated in upper support grooves in such arms — the shaft 148 also being movable upwardly and downwardly in an angularly disposed slot 149 in a support plate 150 located at the right side of the roll 142 and in a like slot as provided in the left side support plate 134 (see also FIG. 1). The take-up roll 142 is spring loaded downwardly in the direction of the shaft 132 (FIG. 3) to yieldingly cooperate with the drive roller 136 thereon (FIG. 2) and to provide proper tension on the journal paper 48 as it is being wound from the supply onto the take-up roll 142, such roll 142 being swingable away from the drive roller 136 as the diameter of the take-up roll increases by reason of additional journal paper being wound and stored thereon. To permit the reqired movement of such take-up roll 142, each of the support arms 144 and 146 includes a lower slotted portion which slidingly engages a guide stud or shaft 147 carried by the support plates 134 and 150 (FIGS. 2 and 3). It is thus seen that when it is desired to increment the journal paper 48 past the printing station, i.e. platen 36, the solenoid 124 is actuated to draw the plunger 122 forward and thereby rock the crank arm 116 clockwise on its support pin 118 (FIG. 3), in turn moving the spur gear 110 thereon into engagement with the drive gear 72 and thereby drive the belt 128. Such driving of the belt 128 in turn rotates the journal drive roller 136 (FIG. 2) against the bias of the take-up roller 142 for driving the journal paper 48 past the printing platen 36 and storing same on the roller 142. As the diameter of journal paper 48 increases on the take-up roller 142, such roller 142 moves freely outwardly along the angularly disposed plate slots 149 of the several support plates 134 and 150.

In the normal operation of the paper drive mechanism hereof, the several transactions mentioned above have independent drive or advancing mechanisms with the exception of the receipt, which advanced with each and every line spacing of the machine. The journal paper 48 may be of the self-contained or carbonless type enabling all printing performed on the receipt paper 42 to likewise apper on the journal paper 48. With such "through" printing, it is possible to print on both the receipt and journal or, through "robbing" of the receipt, to print on multiple-part slips or forms and also on the journal paper 48 during the same transaction.

Although, and as mentioned above, the tension in the belt or O-ring 128 maintains the journal paper drive mechanism in a disengaged position, energization of the solenoid 124 causes the gear 110 to move upwardly across center of the crank arm 116 support pin 118 to engage with the main drive gear 72 and thereby drive the belt 128, in turn driving the journal drive roller 136, which is in direct contact with the journal paper 48, against the bias of the take-up roller 142 for advancing the journal paper 48 past the printing station and storing such paper on the roller 142. During such storing of the journal paper 48, such take-up roller 142 automatically moves in a direction away from the drive roller 136 upon increasing diameter of paper 48 thereon. The drive mechanism hereof of course provides for the selection of advancement of the journal paper 48 in incremental or intermittent manner.

It is thus seen that herein shown and described is a paper drive mechanism wherein journal paper is unwound or unreeled from a supply roll, is caused to be driven past a printing station, and is rewound on a take-up roll in a manner wherein the drive roller therefor is held in a fixed position and the take-up roll moves away from the drive roller as the amount of journal paper thereon is increased. The mechanism enbles the accomplishment of the objects and advantages mentioned above, and while only embodiment of the invention has been disclosed herein, certain variations may occur to those skilled in the art. It is contemplated that all such variations, not departing from the spirit and scope of the invention hereof, are to be construed in accordance with the following claims.

What is claimed is:

1. Drive mechanism for advancing record media from a supply spool to a take-up spool, comprising drive means, means selectively engageable with said drive means and with said take-up spool for effecting drive therebetween, said drive means including clutch mechanism for activating said engageable means in intermittent operation and means supporting said take-up sool permitting movement thereof from said engageable means as the diameter of the record media increases on said spool.

2. The mechanism of claim 1 wherein said engageable means includes a member selectively shiftable to and from engagement with said drive means, and record media advancing means connected from operation with said shiftable member.

3. The mechanism of claim 1 wherein said supporting means includes plate members having angular slots therein and shaft means positioned in said slots and movable therealong upon increase in diameter of said record media on said take-up spool.

4. The mechanism of claim 1 including actuating means operable for moving said engageable means into contact with said drive means for drive of said engageable means and said take-up spool thereby.

5. The mechanism of claim 4 wherein said actuating means comprises a solenoid selectively operable for moving said engageable means into contact with said drive means.

6. The mechanism of claim 3 including means for resiliently urging said shaft means in the direction of said engageable means and said supporting means provides for swinging movement of said take-up spool along said angular slots.

* * * * *